US005325630A

United States Patent [19]

Allenbaugh

[11] Patent Number: 5,325,630

[45] Date of Patent: Jul. 5, 1994

[54] DOOR HOLE COVER

[75] Inventor: Howard M. Allenbaugh, Huntington Beach, Calif.

[73] Assignee: M.A.G. Eng. & Mfg. Inc., Huntington Beach, Calif.

[21] Appl. No.: 53,777

[22] Filed: Apr. 28, 1993

[51] Int. Cl.[5] ..... E05C 7/02; E06B 7/00

[52] U.S. Cl. ..... 49/62; 49/70; 49/463; 49/465; 49/503; 49/506; 49/507

[58] Field of Search ..... 49/62, 70, 460, 463, 49/465, 506, 507, 171, 466, 503

[56] References Cited

U.S. PATENT DOCUMENTS

| | | | |
|---|---|---|---|
| 1,970,836 | 8/1934 | Benson | 49/70 |
| 2,491,758 | 12/1949 | Nichols et al. | 49/171 X |
| 4,562,666 | 1/1986 | Young, III | 49/463 X |
| 5,165,189 | 11/1992 | Besal | 49/466 X |

*Primary Examiner*—Philip C. Kannan

*Attorney, Agent, or Firm*—Pretty, Schroeder, Brueggemann & Clark

[57] ABSTRACT

A door hole cover for covering a hole in a door has two substantially flat cover plates that are secured to opposite sides of the door for covering the door hole. The first cover plate has an attachment tube extending from the center of its inner surface such that the attachment tube is positioned inside the door hole during assembly. A centering disk is placed over the attachment tube and held in place by a retainer clip. A fastener fits through a hole in the second cover plate and engages an internally threaded hole in the attachment tube to secure the first and second cover plates to the door in a position covering the door hole. The centering disk inside the door hole substantially prevents movement of the cover plates in a plane that is parallel with respect to the door. The centering plate may include three removable tabs that are left in place to cover relatively large door holes, but may be removed to cover smaller door holes.

12 Claims, 1 Drawing Sheet

DOOR HOLE COVER

BACKGROUND OF THE INVENTION

The present invention relates to devices for covering holes in doors and, more specifically, to a door hole cover for covering a door hole after a door lock or the like has been removed from the door.

To install a dead bolt lock or a door knob in a door, a circular hole usually is drilled through the door. Later, when the lock or knob is no longer necessary or desired, a hole is left in the door if the lock or knob is removed from the door. For aesthetic and security reasons, so-called door hole covers have been developed to cover the hole left in a door after removal of a lock or knob. One type of door hole cover consists of two circular cover plates, one placed on each side of the door, which are clamped against the door and over the door hole by a screw passing through the door hole. These cover plates typically have small dimples near the outer edges of the plates that contact the door to help maintain the cover plates in frictional contact against the inside and outside surfaces of the door.

Door hole covers of the type described above, however, have suffered from several known disadvantages. For example, if the screw loosens, the cover plates will lose their frictional contact with the door and the plates will drop downward with respect to the door hole. In many instances, the screw will fall to the bottom of the door hole leaving the door hole only partially covered by the plates. In addition, temperature and humidity variations in some environments will cause the door to expand and contract. If such expansion and contraction is sufficient, the frictional contact between the door and the cover plates will be lost over time and the door hole cover will drop.

Another significant drawback associated with the door hole cover described above concerns the susceptability of the plates to tampering by a burglar or intruder. For example, a burglar may pry between one of the cover plates and the door to bend the cover plate so that it is no longer in frictional contact against the door surface, causing the door hole cover to drop downward in the door hole. In addition, a burglar may hammer against the edge of the cover plate, forcing the door hole cover toward the bottom of the hole. In either instance, the hole in the door can be exposed for further tampering and opportunity for unwanted entry.

Hence, not only is the partially covered hole aesthetically undesirable, but it also allows the potential for access through the door permitting possible tampering or entry. Thus, for security reasons it is very desirable to prevent the door hole cover from dropping in the door hole when subjected to forced entry attempts, loosened screws or variations in temperature or humidity.

In addition, it is known that door hole size varies depending upon the type of hardware installed in the door. For example, the door hole for a dead bolt lock is sometimes smaller than the hole for a door knob. Typically, different sized cover plates are used for each different sized hole. Using different sized cover plates requires that several different sized hole covers be manufactured and kept in stock. However, this undesirably increases manufacturing and administrative costs.

Accordingly, there has existed a definite need for a door hole cover that reliably covers a door hole and that can be used to cover several different sized door holes. The present invention satisfies these needs and provides further related advantages.

SUMMARY OF THE INVENTION

The present invention is embodied in a door hole cover and a related method for use in covering door holes and the like. The door hole cover comprises a first cover plate and a second cover plate that are secured to opposite sides of the door by a fastener extending through the door hole. In accordance with the invention, the door hole cover has a special centering disk that positions the cover plates over the door hole and prevents the cover plates from moving with respect to the door hole. Moreover, the door hole cover of the present invention is designed to be relatively simple to install, inexpensive to manufacture and reliable in use.

In one embodiment of the invention, the first cover plate is substantially flat and sized to be slightly larger than the door hole. The first cover plate also includes an attachment tube located substantially at the center of the flat inner surface of the first cover plate, with the axis of the attachment tube situated such that it extends substantially perpendicular to the flat inner surface. The second cover plate is also substantially flat and has a hole at its center. The fastener, preferably an externally threaded machine screw with an enlarged head, fits through the hole in the second cover plate and a centrally located aperture in the centering disk. When the screw is tightened, its enlarged head engages the outer surface of the second cover plate and threadably engages an internally threaded hole in the attachment tube. With this arrangement, the first and second cover plates are positioned securely over the door hole, and the centering disk situated within the door hole advantageously prevents the cover plates from moving in a plane that is parallel with respect to the door.

In a more detailed feature of the invention, the centering disk comprises a main disk having three removable tabs located at substantially equally spaced distances around the circumference of the disk. In this way, the door hole cover can cover holes of at least two different sizes. For example, when a relatively large door hole of about 2 ⅛ inches in diameter needs to be covered, the tabs are left on the main disk, making the effective diameter of the centering disk slightly less than 2 ⅛ inches. When a relatively smaller door hole of about 1 ½ inches in diameter needs to be covered, the tabs can be removed from the main disk, making the effective diameter of the centering disk slightly less than 1 ½ inches. For door holes having a diameter less than 1 ½ inches, the centering disk need not be used.

In another aspect of the invention, the aperture in the centering disk is sized to be slightly larger than the outside diameter of the attachment tube so that the centering disk can be positioned over the attachment tube during installation of the door hole cover. In another feature, a retainer clip fits snugly on the attachment tube for holding the centering disk on the attachment tube against the inner surface of the first cover plate. In this way, the centering disk is held securely in position on the attachment tube inside the door hole to maintain the cover plates in position and further resist tampering efforts.

With the foregoing arrangement, it can be seen that the door hole cover of the present invention is adapted to cover holes in doors of varying sizes. Should the screw become loosened for any reason, the centering disk positioned around the attachment tube inside the door hole prevents the fastener and the first and second cover plates from falling and exposing the door hole. Since the diameter of the centering disk is just slightly smaller than the diameter of the door hole, the centering disk will only be able to move a very limited distance before the circumference of the centering disk engages the portion of the door surrounding the door hole to prevent movement of the covering plates to expose the door hole. In addition, the use of removable tabs on the centering disk allows the door hole cover to be used for different sized door holes. In this way, a single door hole cover can be used to cover different sized holes simply by removing the removable tabs on the main disk. As a result, only a single door hole cover needs to be manufactured and maintained in inventory for most applications. The door hole cover of the present invention also is adapted for use on either wood or steel doors.

Other features and advantages of the present invention will become apparent from the following description of the preferred embodiment, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
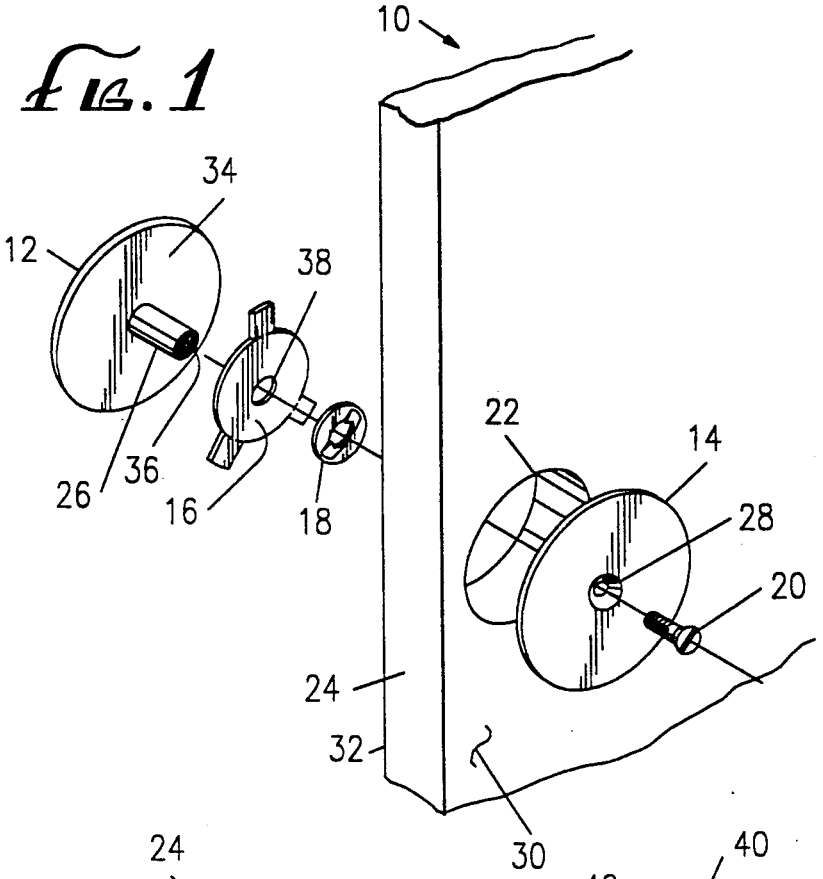
FIG. 1 is an exploded perspective view of a door hole cover embodying the novel features of the present invention.

As shown in the exemplary drawings, the present invention is embodied in a door hole cover, generally referred to by the reference numeral 10, for use in covering door holes and the like. Referring to FIG. 1, the door hole cover 10, in accordance with the invention, is shown in an exploded view prior to assembly. The door hole cover comprises a first cover plate 12, a second cover plate 14, a centering disk 16, a retainer clip 18, and a fastener 20. These elements are shown aligned along a common axis through a hole 22 in a door 24. To assemble the door hole cover 10, as explained in more detail below, the centering disk 16 is inserted axially over an attachment tube 26 of the first cover plate 12. Thereafter, the retainer clip 18 is also inserted axially over the attachment tube 26 to hold the centering disk 16 securely on the attachment tube. The two cover plates 12 and 14 are then placed on opposite sides of the door 24 over the door hole 22. Thereafter, the fastener 20 is inserted axially through a hole 28 in the second cover plate 14 until the fastener engages the attachment tube 26 of the first cover plate 12. The fastener 20 is then tightened to secure the two covers plates 12 and 14 over the door hole 22.

The door hole cover 10 is shown in FIG. 1 for installment in a standard 2 ⅛ inch diameter door hole 22, such as is used with knob type locks. The door 24 has an inside surface 30 (or secure side) and an outside surface 32 (or unsecured side). The first cover plate 12 has a diameter of about 2 ⅝ inch which provides approximately a ¼ inch overlap with the outside surface 32 of the door 24 around the circumference of the door hole 22. After the first cover plate 12 is placed over the door hole 22 from the unsecured side 32 of the door 24, the second cover plate 14, also having a diameter of about 2 ⅝ inches, is positioned on the inside surface 30 of the door 24. Then the fastener 20 is inserted axially through the hole 28 located substantially at the center of the second cover plate 14. The fastener 20 engages the attachment tube 26 and is tightened until the cover plates 12 and 14 are held firmly against the door 24.

Figure 2:
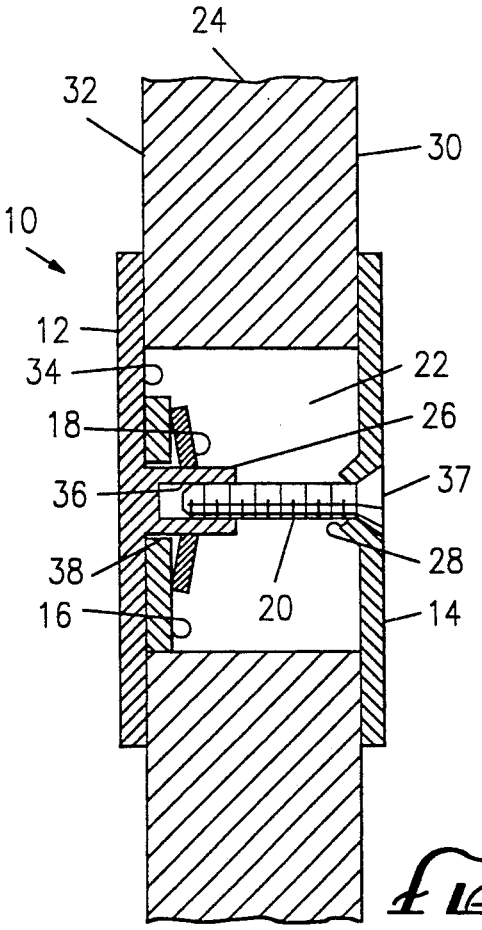
FIG. 2 is a cross-sectional view of a door showing the door hole cover installed over a door hole.

Referring now to FIG. 2, the door hole cover 10 is shown in an assembled condition over the door hole 22. The first cover plate 12 is positioned on the unsecured side 32 of the door 24 and preferably presents a featureless outside surface in the form of a flat, smooth surface resistant to tampering by a burglar or the like. The attachment tube 26 preferably is spot welded to the inside surface 34 of the first cover plate 12 such that the axis of the attachment tube is substantially perpendicular to the inside surface 34 and the tube is located substantially at the center of the cover plate. The attachment tube 26 is closed at the end that is attached to the first cover plate 12. However, the other end of the attachment tube 26 which faces away from the cover plate 12 is open and comprises an internally threaded hole 36. This internally threaded hole 36 is designed to receive the fastener 20, which in the preferred embodiment is an externally threaded machine screw having an enlarged head 37.

The centering disk 16 has a centrally located aperture 38 that is sized to fit over the outside surface of the attachment tube 26. The centering disk 16 is held firmly on the tube 26 by the retainer clip 18. The retainer clip 18 in the preferred embodiment is a one-way nut or similar type retaining clip that slides in frictional contact over the attachment tube 26 toward the first cover plate 12. The retainer clip 18 is designed such that it is almost impossible to remove once it is placed over the attachment tube 26. In one aspect of the invention, the retainer clip 18 is installed on the attachment tube 26 such that the centering disk 16 is positioned firmly against the inside surface 34 of the first cover plate 12. Alternatively, the retainer clip 18 may be installed on the attachment tube 26 such that the centering disk 16 may slide a limited distance along the attachment tube.

In accordance with the invention, the centering disk 16 prevents the door hole cover 10 from dropping in the hole 22. For example, temperature and humidity variation may cause the door 24 to vary in thickness, which variations may cause the cover plates 12 and 14 to lose frictional contact with the door surfaces 30 and 32. However, the centering plate 16 will advantageously engage the portion of the door 24 surrounding the door hole 22 and prevent the cover plates 12 and 14 from dropping in the door hole 22. The centering plate preferably has a thickness of approximately 1/16 inch. Thus, the cover plates 12 and 14 must be quite loose before there is any possibility of them dropping in the hole 22.

Moreover, as explained in more detail below, the effective outer diameter of the centering disk 16 is designed to be just slightly smaller than the diameter of the door hole 22. In this way, the centering disk 16 is allowed to move only a limited distance in a plane that is parallel with respect to the door 24 before it will engage the portion of the door surrounding the door hole 22. Hence, the centering disk 16 is designed such that it will engage the portion of the door 24 surrounding the door hole 22 before either of the cover plates 12 and 14 fall to a point that would expose the door hole.

If a burglar attempts to bend the first cover plate 12 by prying between the first cover plate and the unsecured or outside surface 32 of the door 24, the center disk 16 still prevents the door hole cover 10 from dropping in the hole 22 since it is located entirely within the door hole 22, behind the first cover plate 12, and therefore is not susceptable to tampering. The centering disk 16 also functions as a shield that hampers direct tampering with the second cover plate 14.

Figure 3:
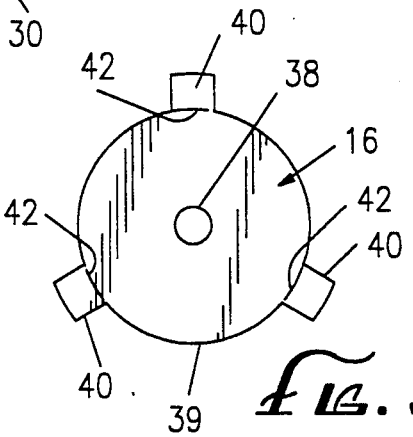
FIG. 3 is a plan view of a centering disk forming a part of the door hole cover, showing three removable tabs on the disk.
Figure 4:
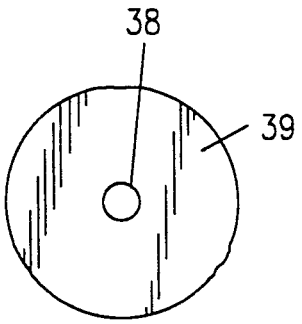
FIG. 4 is a plan view of the centering plate with the tabs removed.

Referring now to FIGS. 3 and 4, the centering disk 16 comprises a main disk 39 with removable tabs 40 which are located at equally spaced locations around the circumference of the main disk. In the preferred embodiment, the main disk 39 has three tabs 40, as shown. The tabs 40 are sized to produce an effective diameter of the centering disk 16 such that the disk fits with minimal clearance within a 2 ⅛ inch diameter hole 22, which is the typical diameter of a hole for a standard door knob. The tabs 40 also are have scores 42 aligned with the circumference of the main disk 39. These tabs 40 are adapted to be readily removed by pliers or the like if the door hole cover 10 is used on a hole 22 having smaller diameter. After the tabs 40 are removed, the centering disk 16 (i.e., now simply the main disk 39) has a diameter sized to fit with minimal clearance within an 1 ½ inch diameter door hole 22, which is sometimes the diameter of a hole for a dead bolt lock.

Even if a burglar was able to remove the scored tabs 40 which are about ¼ inch long, the cover plates 12 and 14, each having a diameter of approximately 2 ⅝ inches, still substantially cover the door hole 22 and inhibit the burglar from bending or otherwise breaching the second cover 14. Moreover, in an 1 ½ inch sized door hole 22, the centering disk. 16 provides additional security since its edges are within the diameter of the hole 22 and thus are difficult to pry and bend.

The door hole cover 10 also can be installed in a door hole 22 having a diameter smaller than 1 ½ inches by installing the covers 12 and 14 without the centering disk 16. With these smaller sized holes, the 2 ⅝ inch covers would still substantially cover the door hole 22 even if the assembly was to drop completely to the bottom of the door hole.

Thus, by using removable tabs on the centering plate, one standard sized door hole cover can be used to cover most standard sized door holes without requiring manufacturing capabilities or an inventory for several different sized door hole covers.

The door hole cover 10 of the present invention also is adapted for use with either wood or steel doors 24. For use on steel doors, the centering disk 16 should be in a position on the attachment tube 26 directly against the inside surface 34 of the first cover plate 12 and held there by the retainer clip 18. For use on wood doors, the centering disk 16 can be either in the same position as for steel doors, or in a position on the attachment tube 26 that is slightly spaced from the inside surface 34 of the first cover plate 12.

From the foregoing, it will be appreciated that the present invention provides a door hole cover 10 for reliably covering a door hole 22 and can be used to cover a variety of different size door holes. The centering disk 16 is resistant to tampering and prevents the door hole cover 10 from dropping in the hole over a wide variation of temperature and humidity. The removal tabs 40 on the centering disk also allow the door hole cover 10 to be used in several different sized holes.

While a particular form of the invention has been illustrated and described, it will be apparent that various modifications can be made without departing from the spirit and scope of the invention. Accordingly, it is not intended that the invention be limited, except as by the appended claims.

I claim:

1. A door hole cover, comprising:

a first cover plate having a substantially flat inner surface for contact with one side of a door and having a size that is larger than the size of a hole in the door;

a second cover plate having a substantially flat inner surface for contact with an opposite side of the door and having a size that is larger than the size of the door hole;

a centering disk having an aperture located substantially at its center and having a size that is slightly less than the size of the door hole; and a fastener adapted to pass through the hole in the door and the aperture in the centering disk and to secure the first cover plate and the second cover plate to the door such that the centering disk within the door hole substantially prevents movement of the first and second cover plates with respect to the door.

2. A door hole cover as defined in claim 1, wherein the centering disk comprises a main disk having a plurality of removable tabs located at substantially equal distances around the circumference of the main disk.

3. A door hole cover as defined in claim 1, wherein the fastener comprises an externally threaded screw adapted to be inserted through a central hole in the second cover plate, the screw having an enlarged head for engagement with the outer surface of the second cover plate, and wherein the first cover plate has an internally threaded attachment tube adapted to extend inwardly into the door hole for threaded engagement with the fastener to secure the first and second cover plates to the door.

4. A door hole cover as defined in claim 3, wherein the centering disk is adapted to be mounted on the attachment tube by inserting the attachment tube through the aperture in the centering disk.

5. A door hole cover as defined in claim 4, further comprising a retainer clip adapted to frictionally engage the attachment tube to hold the centering disk on the attachment tube against the inner surface of the first cover plate.

6. A door hole cover, comprising:

a first cover plate having a substantially flat inner surface for contact with one side of a door and having a diameter that is larger than the diameter of a hole in the door;

a second cover plate having a substantially flat inner surface for contact with an opposite side of the door and having a diameter that is larger than the diameter of the door hole;

an attachment tube extending in a substantially perpendicular direction from the inner surface of the first cover plate such that the attachment tube extends into the door hole when the inner surface of the first cover plate is against the one side of the door;

a centering disk having a centrally located aperture for mounting the centering disk on the attachment tube, wherein the centering disk has an outer diameter that is slightly smaller than the diameter of the door hole; and a fastener adapted to be inserted through a central hole in the second cover plate, the fastener having an enlarged head for engagement with the outer surface of the second cover plate, wherein the fastener is adapted to be connected to the attachment tube such that the first cover plate and the second cover plate are secured to opposite sides of the door covering the door hole, and the centering disk within the door hole substantially prevents movement of the first and second cover plates in a plane parallel to the door.

7. A door hole cover as defined in claim 6, wherein the centering disk comprises a main disk having a first diameter and a plurality of removal tabs located along the circumference of the main disk to define a second diameter.

8. A door hole cover as defined in claim 6, further comprising a retainer clip adapted to fit snugly on the attachment tube for holding the centering disk against the inner surface of the first cover plate.

9. A door hole cover as defined in claim 8, wherein the fastener has an externally threaded shaft adapted to engage an internally threaded hole in the attachment tube.

10. A door hole cover as defined in claim 9, wherein the length of the fastener is less than the thickness of the door, but long enough to engage the internally threaded hole of the attachment tube.

11. A door hole cover for covering a door hole, comprising:

a first cover plate having a substantially flat inner surface for contact with one side of a door and having a diameter that is larger than the diameter of a hole in the door;

an attachment tube extending in a substantially perpendicular direction from the inner surface of the first cover plate such that the attachment tube extends into the door hole when the inner surface of the first cover plate is against the one side of the door;

a second cover plate having a substantially flat inner surface for contact with an opposite side of the door and having a diameter that is larger than the diameter of the door hole;

a centering disk having a centrally located aperture for mounting the centering disk on the attachment tube, wherein the centering disk has an outer diameter that is slightly smaller than the diameter of the door hole;

a retainer clip adapted to frictionally engage the attachment tube for holding the centering disk on the attachment tube; and an externally threaded fastener adapted to be inserted through a central hole in the second cover plate, the fastener having an enlarged head for engagement with the outer surface of the second cover plate, wherein the externally threaded fastener is adapted to engage an internally threaded hole in the attachment tube such that the first cover plate and the second cover plate are secured to opposite sides of the door in a position covering the door hole, and the centering disk within the door hole substantially prevents movement of the first and second cover plates in a plane that is parallel with respect to the door.

12. A method of covering a hole in a door, comprising the steps of:

providing a first cover plate having a substantially flat inner surface for contact with one side of a door and having a diameter that is larger than the diameter of a hole in the door, wherein the first cover plate has an attachment tube extending in a substantially perpendicular direction from the inner surface thereof such that the attachment tube extends into the door hole when the inner surface of the first cover plate is against the one side of the door;

assembling a centering disk with a centrally located aperture over the attachment tube, wherein the centering disk has a diameter that is slightly smaller than the diameter of the door hole;

inserting a retaining clip over the attachment tube to retain the centering disk in position on the attachment tube;

inserting the attachment tube and centering disk into the door hole and centering the first cover plate with respect to the door hole such that the entire door hole is covered by the first cover plate;

placing a second cover plate having a substantially flat inner surface in contact with an opposite side of the door such that the second cover plate covers the door hole;

inserting an externally threaded fastener through a centrally located hole in the second cover plate such that the externally threaded fastener engages an internally threaded hole in the attachment tube; and tightening the fastener until an enlarged head on the fastener engages the outer surface of the second cover plate and securely clamps the first and second cover plates to opposite sides of the door in a position covering the door hole.

* * * * *